US007267325B2

(12) United States Patent
Tsai

(10) Patent No.: US 7,267,325 B2
(45) Date of Patent: Sep. 11, 2007

(54) AERATION METHOD OF POOL WATER AND APPARATUS THEREOF

(75) Inventor: Rong-Feng Tsai, Yunlin Hsien (TW)

(73) Assignee: National Huwei University of Science and Technology, Yunlin (TW)

( * ) Notice: Subject to any disclaimer, the term of this patent is extended or adjusted under 35 U.S.C. 154(b) by 77 days.

(21) Appl. No.: 11/200,207

(22) Filed: Aug. 10, 2005

(65) Prior Publication Data

US 2006/0032797 A1 Feb. 16, 2006

(30) Foreign Application Priority Data

Aug. 11, 2004 (TW) ..... 93124109 A
Nov. 10, 2004 (TW) ..... 93134318 A

(51) Int. Cl.
*B01F 3/04* (2006.01)

(52) U.S. Cl. ..... 261/34.1; 261/115; 261/120

(58) Field of Classification Search ..... 261/34.1, 261/36.1, 37, 115, 120; 210/242.1, 242.2
See application file for complete search history.

(56) References Cited

U.S. PATENT DOCUMENTS 3,998,389 A * 12/1976 Rose et al. ..... 239/214.21
4,193,951 A * 3/1980 Stanley ..... 261/91
4,587,064 A * 5/1986 Blum ..... 261/37
4,690,756 A * 9/1987 Van Ry ..... 210/221.2
4,699,737 A * 10/1987 Engstrand ..... 261/24
4,734,235 A * 3/1988 Holyoak ..... 261/91
5,227,056 A * 7/1993 Makino ..... 210/170.06
6,050,550 A * 4/2000 Burgess ..... 261/29
6,083,405 A * 7/2000 Tanaka et al. ..... 210/739
6,257,560 B1 * 7/2001 Kim ..... 261/36.1
6,585,236 B2 * 7/2003 Tanabe et al. ..... 261/91

* cited by examiner

*Primary Examiner*—Scott Bushey
(74) *Attorney, Agent, or Firm*—Birch, Stewart, Kolasch & Birch, LLP

(57) ABSTRACT

An aeration method of a water pool and an apparatus thereof are disclosed, suitable for use in an aquatic pool or an aerobic processing pool. The aeration method requires placing at least one biofilter device in the water pool. An aeration apparatus comprises a pumping device and at least one projecting pipe connected to the pumping device. A plurality of nozzles is set on the projecting pipe. The pool water can be pumped into the projecting pipe by the pumping device, and the pool water pumped from the water pool is sprayed through the nozzles to the water pool and the biofilter device. The aeration apparatus may be a jet aeration apparatus or a wide-angle ejecting aeration apparatus.

6 Claims, 10 Drawing Sheets

AERATION METHOD OF POOL WATER AND APPARATUS THEREOF

RELATED APPLICATIONS

The present application is based on, and claims priority from, Taiwan Application Serial Number 93124109, filed Aug. 11, 2004, and Taiwan Application Serial Number 93134318, filed Nov. 10, 2004 the disclosures of which are hereby incorporated by reference herein in their entirety.

FIELD OF THE INVENTION

The present invention relates to an aeration method of pool water and an apparatus thereof, and more particularly, to a method and an apparatus that can increase the amount of dissolved oxygen (DO) of pool water to reduce the concentration of organic matter, i.e. the biochemical oxygen demand (BOD)/chemical oxygen demand (COD) in the pool water.

BACKGROUND OF THE INVENTION

Aquatic pools, fishponds or fishing farms usually requires aeration devices to maintain the concentration of dissolved oxygen (DO), which is absolutely necessary and important to the breathing of aquatics, underwater organisms and microorganisms, the stabilization of water quality, and the ecological balance of aquatic pools. The microorganisms have to absorb dissolved oxygen from the water to decompose the redundant organic material and to perform nitrification, which transforms ammonia of higher toxicity into nitrous or nitric acid ($NO_2^-$, $NO_3^-$) of lower toxicities. A paddlewheel, a typical conventional aeration device, splashes the water into the air by its vane wheels driven by a motor, and it increases the contact time and surface area between the water droplets and air, so as to achieve the purposes of aeration and increasing the dissolved oxygen.

An aerobic treatment pool in a waste water treatment factory of the general environmental protection and the chemical industries also use microorganisms to decompose the organic materials in the water. In these applications, a blowing machine, an air pipe and air diffusers are typically used to transport air to the bottom of the pool, at which the air is transformed as a plurality of small air bubbles and released at the bottom of a pool. The mixing of small air bubbles and water increases the concentration of dissolved oxygen of the pool water, and, therefore, promotes the decomposition rate of the organic materials by microorganisms.

The efficiency of feeding oxygen increases with the increase of contacting surface area and the staying time of the bubbles in the water. Therefore, smaller bubbles are preferred. However, smaller gas outlets are much more likely to be adhered to and blocked by the microorganisms and suspended substances in the water. As a result, the air diffuser needs to be changed from time to time. The blowing machine and air diffuser are more suitable to be applied in an aerobic treatment pool associated with smaller water volumes and higher concentrations of BOD/COD. Aquatic pools are usually of much larger area and lower BOD/COD (between 10 ppm and 40 ppm), and their depths are between one and two meters. Therefore, the combination of blowing machine and air diffuser is not suitable to aquatic pools since the staying time of air bubbles is too short to an economical efficiency, and too many diffusers are required for large pools.

As a result, there is a need to provide a cost-effective method, which can greatly increase the concentration of dissolved oxygen close to the bottom of the pool.

SUMMARY OF THE INVENTION

An objective of the present invention is to provide an cost-effective aeration method of pool water by spraying water into small droplets, which can largely increase the concentration of dissolved oxygen, and, therefore, accelerate the decomposing rate of organic matter in the pool, effectively reduce the amount of fouling as well as the concentration of BOD, suppress the fermentation of the organic matter, and suppress the growth of harmful germs in the pool.

Another objective of the present invention is to provide an aeration apparatus of pool water, which can effectively increase the amount of dissolved oxygen of the pool water. The aeration apparatus of the present invention is more cost-effective than the combination of a blower and air diffuser. Furthermore, the present aeration apparatus is free of the problem of blockage of air diffusers due to the formation of bio-films.

Yet another objective of the present invention is to provide an aeration apparatus of pool water, which includes a plurality of single-hole low-pressure atomizer, a plurality of multi-hole low-pressure atomizers, or the combination of the above-mentioned atomizers. Therefore, liquid having large flow can be nebulized at low pressure, so as to aerate a great deal of the liquid and achieve the effect of increasing the amount of dissolved oxygen.

Still another objective of the present invention is to provide an aeration apparatus of pool water, in which a pumping device is located under the water and beneath/below a pontoon device, so that the center of gravity of the aeration apparatus is too low to be overturn. As a result, the aeration apparatus can keep its balance even under rainstorm.

Still another objective of the present invention is to provide an aeration apparatus of pool water, which is a jet aeration apparatus. Each jet of single-hole low-pressure atomizers of the aeration apparatus can be set with a conical diversion rod or a wedge-shaped diversion rod with an increasing size, so the diffusion angle of the water spray can be widened to enhance the aeration efficiency and effectively stabilize the ecological balance of the pool water.

Yet another objective of the present invention is to provide an aeration apparatus of pool water, which is a jet aeration apparatus of higher aeration efficiency and better ability to stabilize the ecological balance of the pool water. Consequently, it can reduce the consumption of underground water of aquaculture, and mitigate the problem of land subsidence.

Another objective of the present invention is to provide an aeration apparatus of pool water, which is a wide-angle ejecting aeration apparatus having a plurality of jet channels with gradually decreasing sizes, and the hole size close to the exit of each flow channel is decreased from the inlet to the outlet.

With such jet channels, a great deal of liquid flow into the inlet of a larger section area, and was subsequently accelerated due to the reduction of the section area of the flow channel, and was finally ejected through the outlet to form a plurality of tiny water droplets, so as to increase the aeration effect and the concentration of dissolved oxygen as well.

Still another objective of the present invention is to provide an aeration apparatus of pool water, which is a wide-angle ejecting aeration apparatus. By applying the aeration apparatus, the aeration efficiency can be greatly enhanced, more energy can be economized, and the usage time of the pool water can be elongated to decrease the frequency of changing water, so as to save water. Moreover, the consumption of the underground water and the frequency of changing water are decreased, so the problem of land subsidence can be mitigated. The present invention is suitable for an indoor aquatic pool for cultivating benthos and poor-mobility shellfish, such as shrimp, spiral shells, clam, small abalone, lobster and abalone. The present invention is further suitable for the aeration treatment of highly polluted water.

According to the aforementioned objectives, the present invention provides an aeration method of pool water, suitable for use in an aquatic pool/aerobic processing pool. The aeration method of pool water comprises: providing at least one biofilter device connected to the aquatic pool/aerobic processing pool; and providing an aeration device. The aeration device comprises a pumping device and at least one horizontal pipe connected to the pumping device. A plurality of nozzles is set on the horizontal pipe. The pool water can be pumped into the projecting pipe subsequently through the nozzles by a pumping device, and finally sprayed into the water pool and the biofilter device.

According to a preferred embodiment of the present invention, the projecting pipe is at positions of about 0.5 meters to about 2 meters above the water surface of the aquatic pool/aerobic processing pool.

According to the aforementioned objectives, the present invention further provides an aeration apparatus of pool water, comprising a pumping device, at least one pontoon device, a first bypass main pipe and a plurality of single-hole low-pressure atomizers. The pontoon device is located at the outer side of the pumping device, wherein the pontoon device includes at least one support, and the support is connected to the pumping device. The first main pipe is connected to the pumping device, and its wall was machined a plurality of connection holes, each of which can be used to connect a single-hole low-pressure atomizers, respectively.

According to a preferred embodiment of the present invention, the pumping device is located below the pontoon device, so that the gravity center of pumping device is below the water surface and easy to keep its balance when the aeration apparatus is in operation. Additional main pipes can be installed on top of the first main pipe of the present aeration apparatus, and a plurality of multi-hole low-pressure atomizers can be equipped on the additional main pipe, so as to increase the flow rate of the aerated water.

According to the aforementioned objectives, the present invention further provides an aeration apparatus of pool water, comprising a pumping device, at least one pontoon device, a height adjuster and a top spraying main base. The pontoon device is located at the outer side of the pumping device and connected to the pumping device. The height adjuster is connected to the top of the pumping device. The top spraying main base is correspondingly connected to the top of the height adjuster, and the top spraying main base is a lid, in which a bottom surface of the top spraying main base is an inclined plane, and a plurality of flow channels are set in the bottom surface and extend toward the edge of the bottom surface. The dimension of each flow channel is decreased from the inlet to the outlet.

According to a preferred embodiment of the present invention, the pumping device is located below the pontoon device, so that its gravity center is below the water surface and easy to keep its balance when it is in operation.

DETAILED DESCRIPTION OF THE PREFERRED EMBODIMENT

Figure 1:
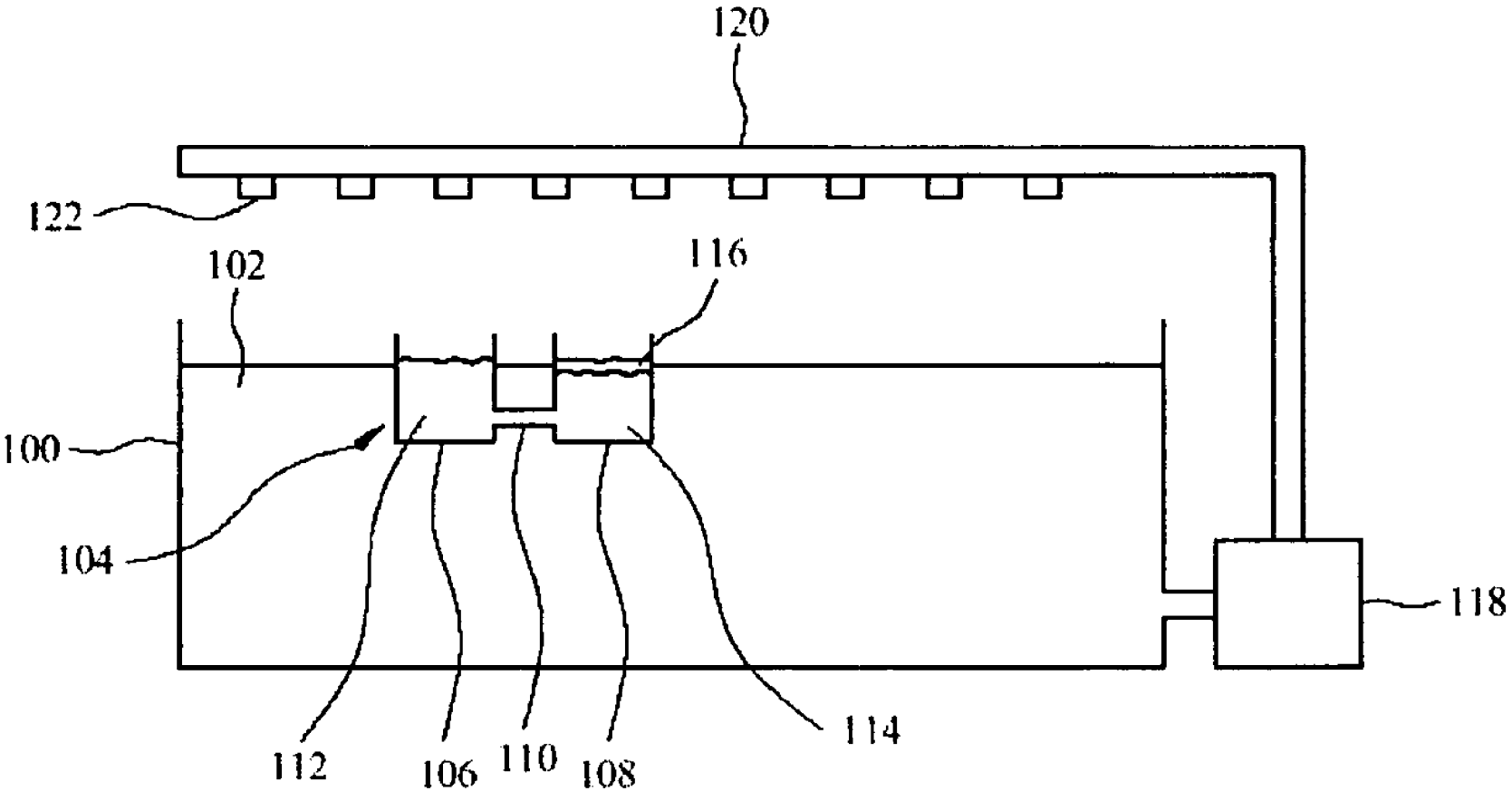
FIG. 1 is a schematic diagram of an aeration apparatus in accordance with a preferred embodiment of the present invention.

FIG. 1 is a schematic diagram of an aeration apparatus in accordance with a preferred embodiment of the present invention. The aeration method of the pool water can be applied in an aquatic pool 100 for example, in which the aquatic pool 100 can be an outdoor aquatic pool, and is preferably an indoor aquatic pool. It is worthy of note that the method of the present invention can also be applied in sewage treatment, and an aerobic processing pool, alternatives of the aquatic pool 100. One or more biofilter devices 104 are placed in the aquatic pool 100, which is filled with pool water 102, depending on the need. Each biofilter device 104 can be preferably composed of a biofilter 106 and a biofilter 108, in which the biofilter 106 is connected to the biofilter 108 with a connection pipe 110. The biofilter 106 and the biofilter 108 are respectively filled with a biofilter material 112 and a biofilter material 114. In one preferred embodiment of the present invention, the biofilter 108 further includes an active carbon layer 116 covering the biofilter material 114. The pollutants can be absorbed by the active carbon layer 116 and adhere to the surface of the carbon of the active carbon layer 116 to eliminate the pollutants in the pool water 102. The active carbon layer 116 further can eliminate the peculiar smell, the tinges, the residual chlorine and the pernicious organic chemical materials. The biofilter device 104 can be deposed inside or outside the aquatic pool 100. When the biofilter device 104 is placed outside the aquatic pool 100, the pool water 102 flowing through the biofilter device 104 should flow back to the aquatic pool 100.

The aquatic pool 100 is further set with aquatic cultivating devices, comprising a pumping device 118, at least one horizontal pipe 120 and a plurality of nozzles 122. The pumping device 118 can be equipped inside or outside the aquatic pool 100, and is preferably outside the aquatic pool 100 for better efficiency. The pumping device 118 can be connected to one or more horizontal pipes 120, and the nozzles 122 are set on the horizontal pipe 120. In one preferred embodiment of the present invention, the horizontal pipe 120 is at positions above the pool water 102 by about 0.5 to 2 meters. The pumping device 118 is connected to the aquatic pool 100, and the pool water 102 is pumped to the horizontal pipe 120 and sprayed to the aquatic pool 100 and the biofilter device 104 through the nozzles 122. The concentration of dissolved oxygen of the pool water 102 is largely increased due to the aeration effect spraying atomization, and the pool water 102 flowing into the biofilter device 104 is of a higher dissolved oxygen concentration, which can increase the growth rate of the germs in the biofilter material 112 and the biofilter material 114. Therefore, the processing rate of the organic matter in the aquatic pool 100 is increased, which thereby effectively reduces the amount of fouling in the aquatic pool 100 and lowers the values of BOD of the pool water 102.

Figure 3:
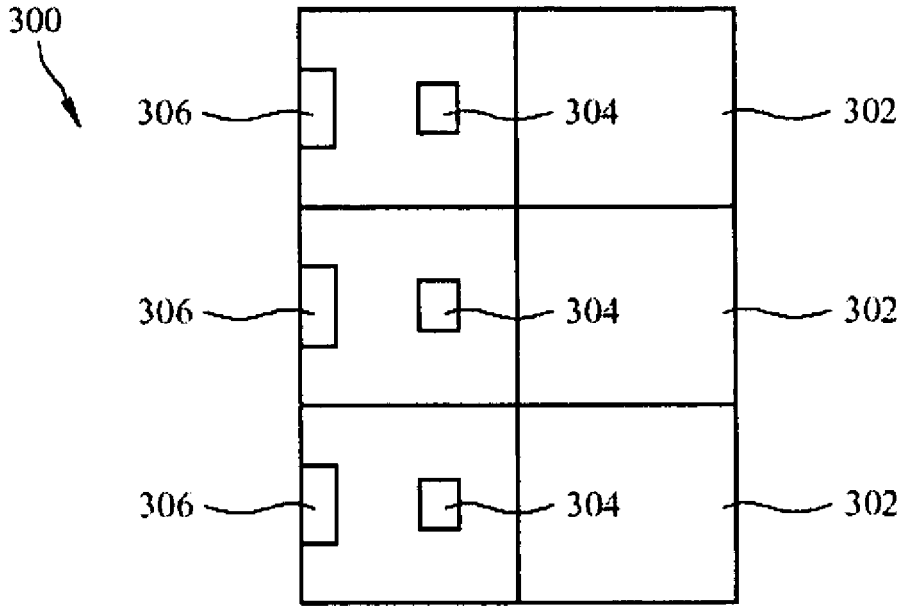
FIG. 3 is a schematic diagram of an aerobic processing pool in accordance with another preferred embodiment of the present invention.

When the method is applied to aerobic processing pools, the aerobic-processing pool is typically of a meandering design, or several aerobic processing pools are connected with each other, to increase the residence time of the water. In one preferred embodiment of the present invention, an aerobic processing pool 300 is composed of several processing pools 302 connected to each other, such as shown in FIG. 3. At least one of the processing pools 302 is equipped with a biofilter device 304. In the preferred embodiment, three processing pools 302 are each equipped with a biofilter device 304. The biofilter device 304, similar to 104, is preferably composed of two biofilters, and one of the biofilters further includes an active carbon layer covering the filtering material in it. In the aerobic processing pool 300, the biofilter device 304 can be equipped inside or outside the processing pool 302. When the biofilter device 304 is placed outside the processing pool 302, the pool water is finally ejected from the processing pool 302, which includes the biofilter device 304 and an aeration device 306. The components and the installation of the aeration device 306 may be similar to those of the aquatic cultivating device in the aforementioned embodiment.

Figure 2:
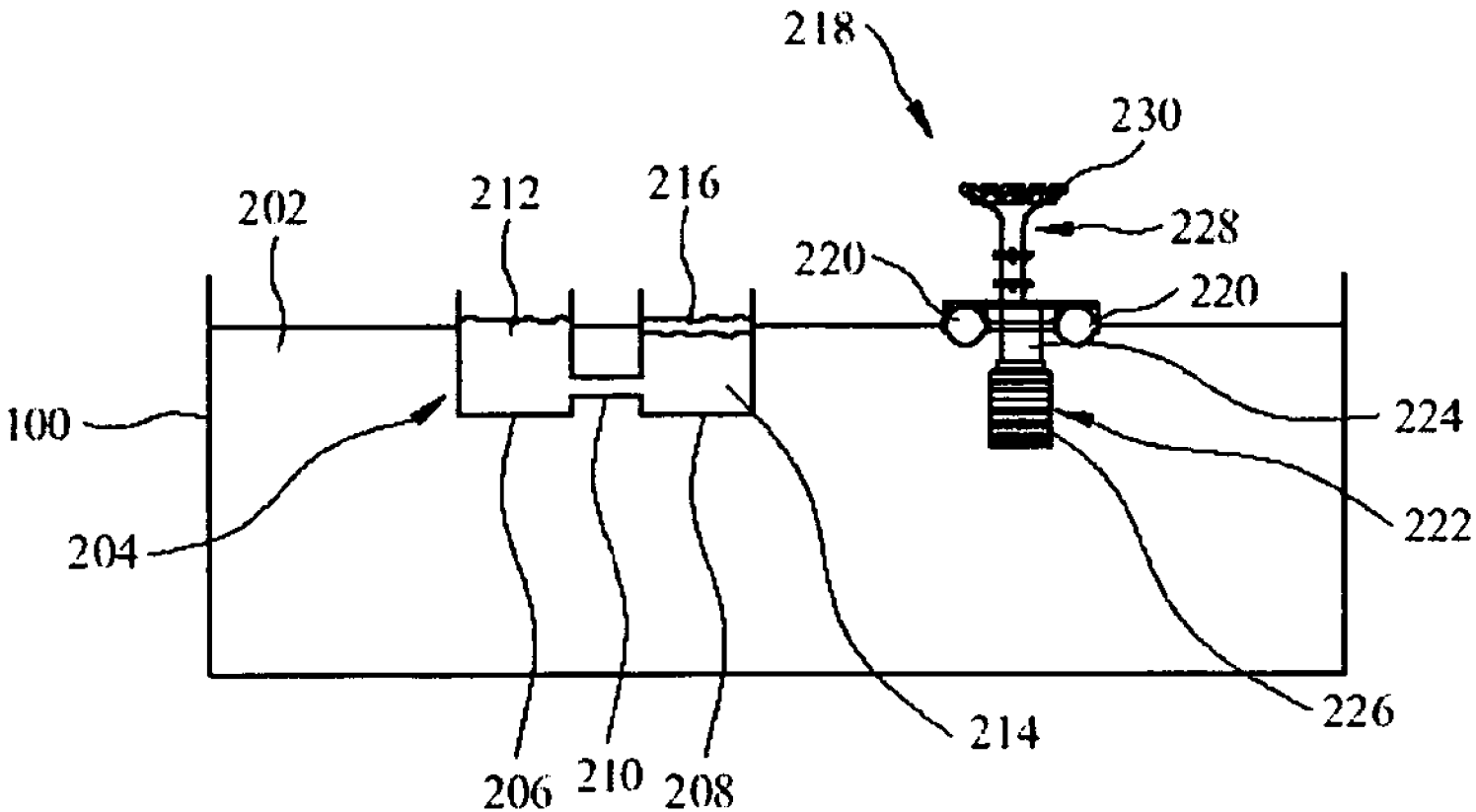
FIG. 2 is a schematic diagram of an aeration apparatus in accordance with another preferred embodiment of the present invention.

FIG. 2 is the schematic diagram of an aeration apparatus in accordance with another preferred embodiment of the present invention. The aeration method of the pool water may also be applied in an aquatic pool 200 for example, in which the aquatic pool 200 may be an indoor aquatic pool, and is preferably an outdoor aquatic pool. One or more biofilter devices 204 are deposed in the aquatic pool 200, which is filled with pool water 202, depending on the necessity. In the present invention, each biofilter device 204 is preferably composed of two biofilters, i.e. a biofilter 206 and a biofilter 208, and the biofilter 206 is connected to the biofilter 208 with a connection pipe 210. The biofilter 206 and the biofilter 208 are respectively filled with a biofilter material 212 and a biofilter material 214. In a preferred embodiment of the present invention, the biofilter 208 further includes an active carbon layer 216 covering the biofilter material 214 to eliminate the pollutants, the peculiar smell, the tinges, the residual chlorine and the pernicious organic chemical materials.

An aeration device 218 is deposed in the aquatic pool 200. The aeration device 218 is mainly composed of a pontoon device 220, a pumping device 222 and an atomization device 228, in which the pumping device 222 is connected to the spray device 228. The pumping device 222 may be composed of a water pump 224 and a filter 226, in which the pool water 202 is filtered by the filter 226. A plurality of atomizers 230 are set on the spray device 228 to outwardly jet the pool water 202 pumped by the pumping device 222, and then the pool water 202 falls into the aquatic pool 200 and the biofilter device 204. The atomizers 230 of different diameters may be selected depending on the practical requirements, such as flow rate, nebulization effect and block-proofing. For example, the atomizers 230 may be single-hole low-pressure atomizers.

The pool water 202 is effectively aerated to increase the amount of dissolved oxygen of the pool water 202 by pumping and spraying the water with the aeration device 218, so that the pool water 202 entering the biofilter device 204 is of a higher dissolved oxygen concentration to increase the growth speed of the germs in the biofilter device 204. Therefore, the processing rate of the organic matter in the aquatic pool 200 is increased, which thereby effectively reduces the amount of fouling in the aquatic pool 200 and lowers the values of BOD of the pool water 202.

Consequently, the dissolved oxygen concentration of the pool water, which is in the aquatic pool and enters the biofilter material, can be effectively enhanced by applying the combination of the aeration method of pumping and spraying as well as using the biofilter material, so that the aeration efficiency of the present invention is higher. Accordingly, the processing rate of the organic matter in the aquatic pool is increased, which thereby rapidly reduces the amount of fouling and the values of BOD in the aquatic pool, further avoids the ferment of the organic matter, prevents the propagation of the germs, and effectively increases the survival rate of the aquatics. Compared with the conventional method of injecting gas to increase the concentration of dissolved oxygen, the present invention is more economical, and the frequency of changing water is decreased due to the water quality being effectively improved; thereby the cost of the present invention is lower.

Figure 4:
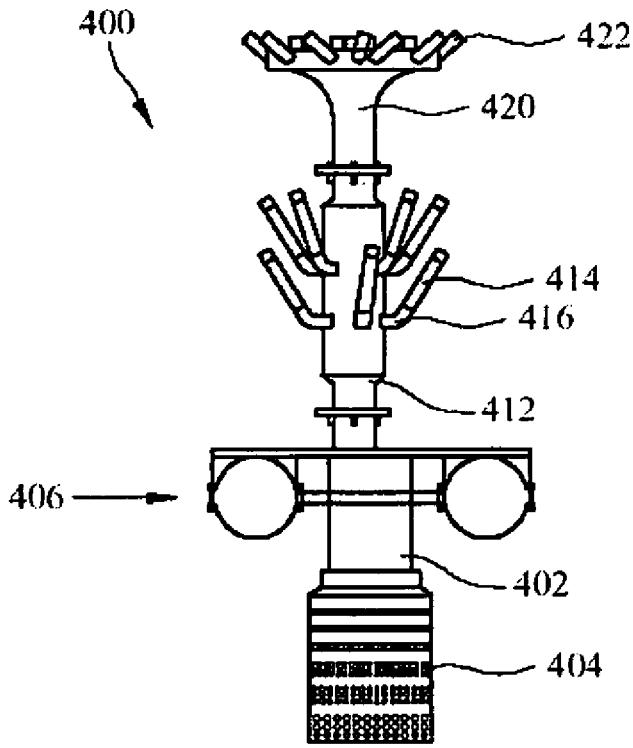
FIG. 4 is a front view of a jet aeration apparatus in accordance with a preferred embodiment of the present invention.
Figure 5:
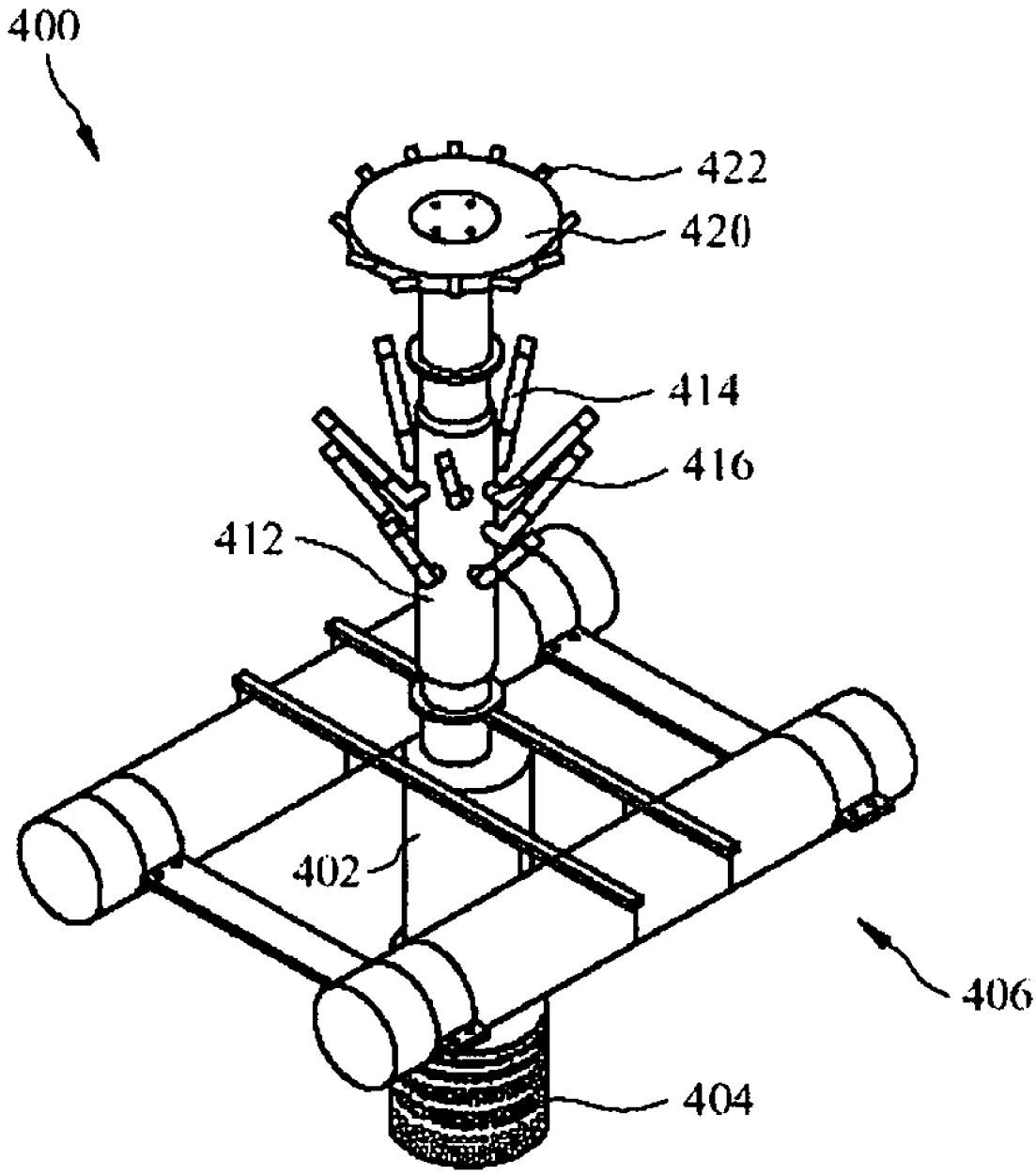
FIG. 5 is a three-dimensional diagram of a jet aeration apparatus in accordance with a preferred embodiment of the present invention.

The aeration device of the present invention may be a jet aeration apparatus. Referring to FIGS. 4 and 5, a jet aeration apparatus 400 is mainly composed of a pumping device 402, a filter 404, a pontoon device 406, a main pipe 412, a main pipe 420, single-hole low-pressure atomizers 414 and multi-hole low-pressure atomizers 422, such as shown in FIGS. 4 and 5. The filter 404 is connected to the bottom of the pumping device 402 and is used to filter the pumped water during the operation of the jet aeration apparatus 400.

A feature of the present invention is that the pumping device 402 is submerged and located under the water, so that the gravity center of the whole jet aeration apparatus 400 is under the water. Therefore, the jet aeration apparatus 400 can keep its balance automatically like a tumbler with little possibility to be overturn.

The main pipe 412 is installed in the pumping device 402. The atomization effect of atomizers 414 of a larger diameter are worse than those of smaller ones, which is more susceptible blocked by foreign matter. In the application, the diameter of the single-hole low-pressure atomizer 414 is preferably between 6 and 20 mm, which is a good compromise between flow rate, atomization and aeration efficiency and block-proofing. The flow rate of the single-hole low-pressure atomizer 414 with a diameter of 12 mm is between about 40 l/min and 80 l/min at a pressure head of between 5 meters and 15 meters. When the single-hole low-pressure atomizer 414 is installed in the main pipe 412, one end of a dual-male curved connection 416 is fixed in the main pipe 412, and the single-hole low-pressure atomizer 414 is then screwed and fixed on the other end of the dual-male curved connection 416. In the present invention, the dual-male curved connection 416 has a curved angle, which is turned upwardly, in which the curved angle is preferably between 10 and 40 degrees.

For example, a single-hole low-pressure atomizer of 12 mm, at elevation angles of between 20 degrees and 30 degrees and pressure head of 10 meters, the jet distance is 7 and 15 meters under the wind velocities of 0 and 10 m/sec; respectively. With similar boundary conditions but an elevation angles of 0 degrees (dual male straight curved connection), the jet distance is decreased to only 5 and 11 meters under the wind velocities of 0 and 10 m/sec; respectively.

In addition, a main pipe 420 can be installed on top of another main pipe 412. In the present invention, the jet elevation angle of flow channel of the multi-hole low-pressure atomizer 422 is between 20 and 30 degrees. It is worthy of note that the jet aeration apparatus of the present invention may be composed of single-hole low-pressure atomizers and a submerged pumping device, or single-hole low-pressure atomizers and multi-hole low-pressure atomizers, etc., and each of the two combinations belongs to one variant of the jet aeration apparatus of the present invention.

Figure 6:
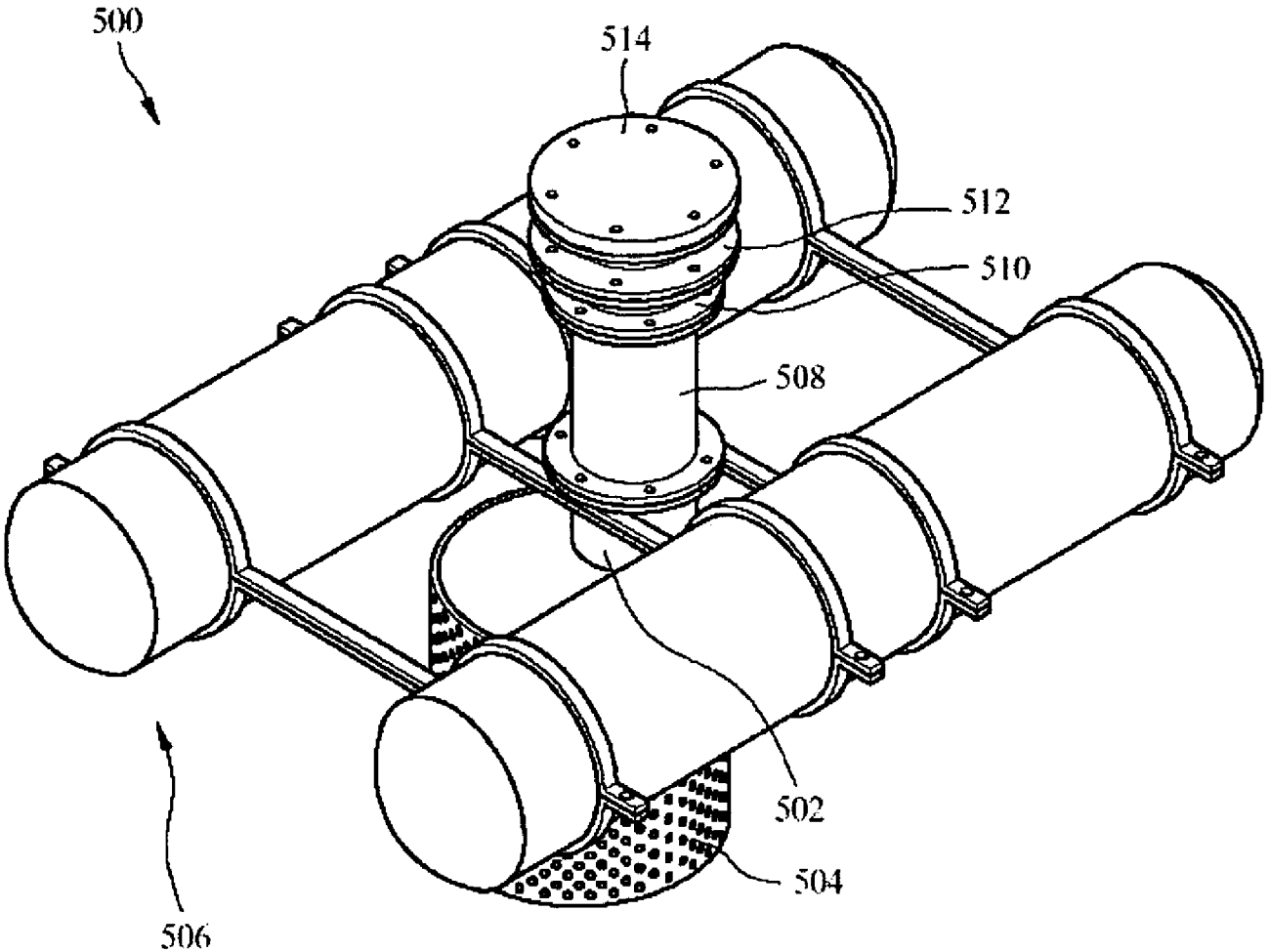
FIG. 6 is an enlarged schematic diagram of a bypass main pipe and single-hole and low-pressure atomizers of a jet aeration apparatus in accordance with a preferred embodiment of the present invention.

The aeration device of the present invention may be a wide-angle ejecting aeration apparatus. Referring to FIGS. 6 to 11, a wide-angle ejecting aeration apparatus 500 is mainly composed of a pumping device 502, a filter 504, a pontoon device 506, a height adjuster 508, a connection base 510, a spraying main base 512 and a top spraying main base 514, such as shown in FIG. 6. The filter 504 is connected to the bottom of the pumping device 502. The pontoon device 506 is located at the outer side of the pumping device 502 and is used to let the wide-angle ejecting aeration apparatus 500 float on the pool water and easily move on the water. The pumping device 502 is located under the pontoon device 506.

The height adjuster 508 is connected to the top of the pumping device 502. The altitude of the height adjuster 508 is designed according to the wind velocity, the size of the water pool, and the performance curve of pressure and flow of the pumping device, to increase the time of the sprayed water staying in the air and the aeration efficiency. The connection base 510 is installed on the height adjuster 508 and is connected to the height adjuster 508 by using a flange 524. The top of the connection base 510 includes a flange 526.

Figure 7:
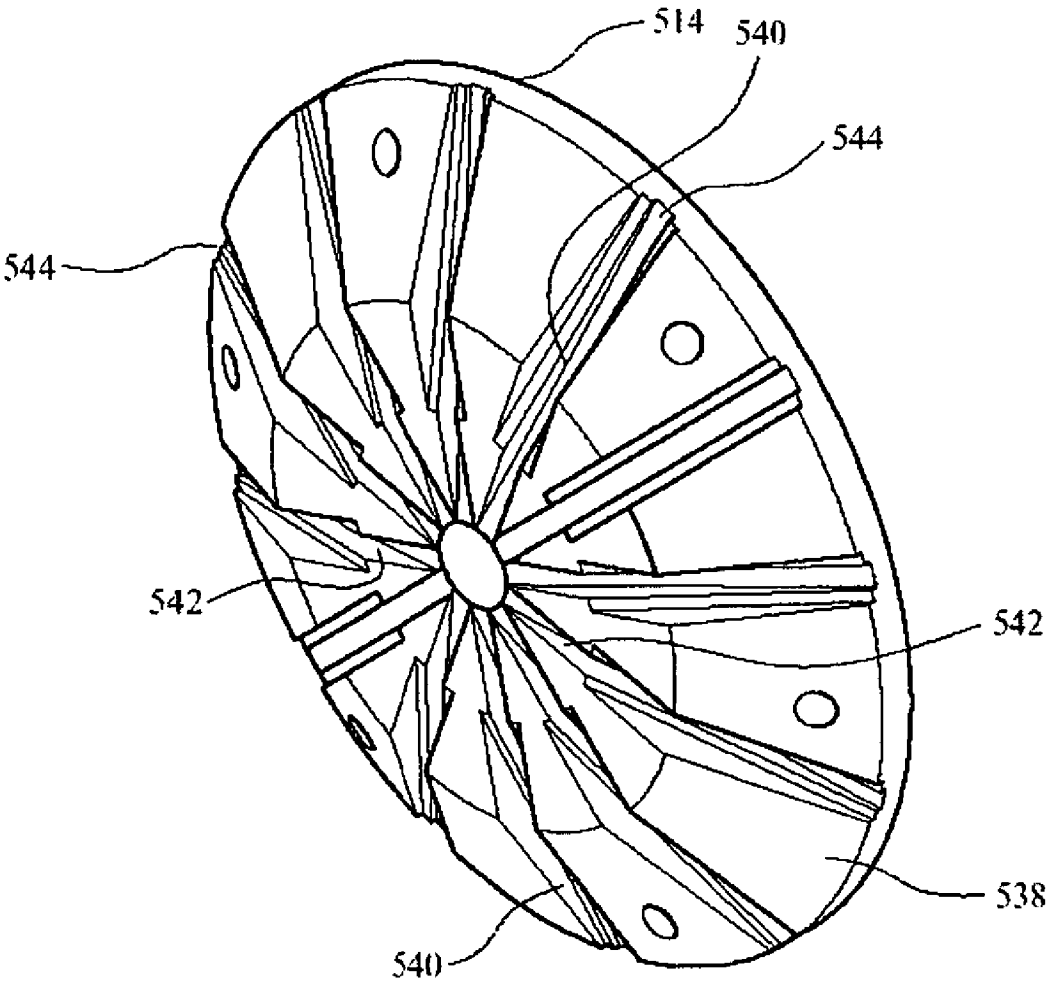
FIG. 7 is an enlarged schematic diagram of a first spraying main base of a wide-angle ejecting aeration apparatus in accordance with another preferred embodiment of the present invention.
Figure 8:
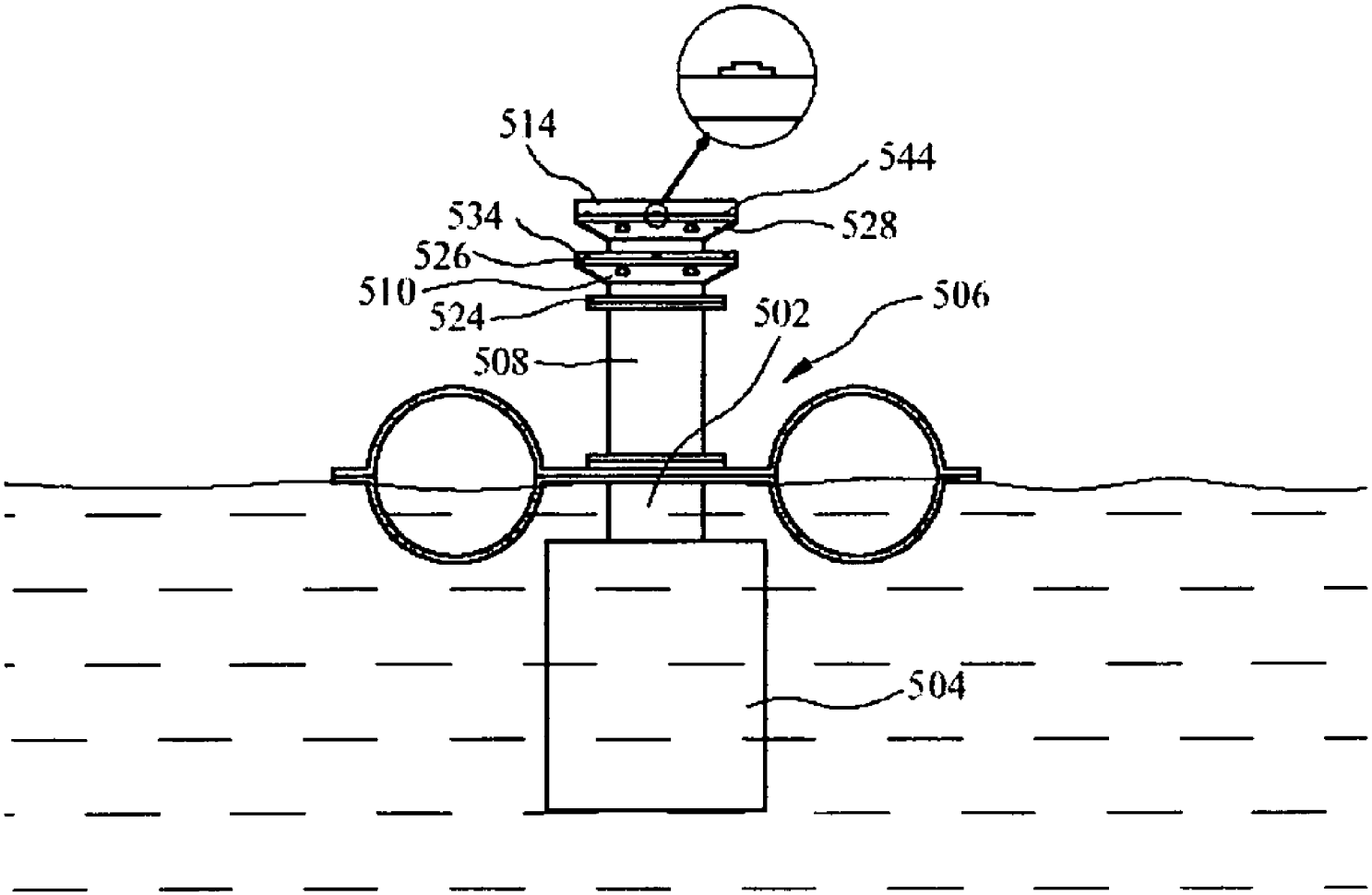
FIG. 8 is a front view of a wide-angle ejecting aeration apparatus in accordance with another preferred embodiment of the present invention.
Figure 9:
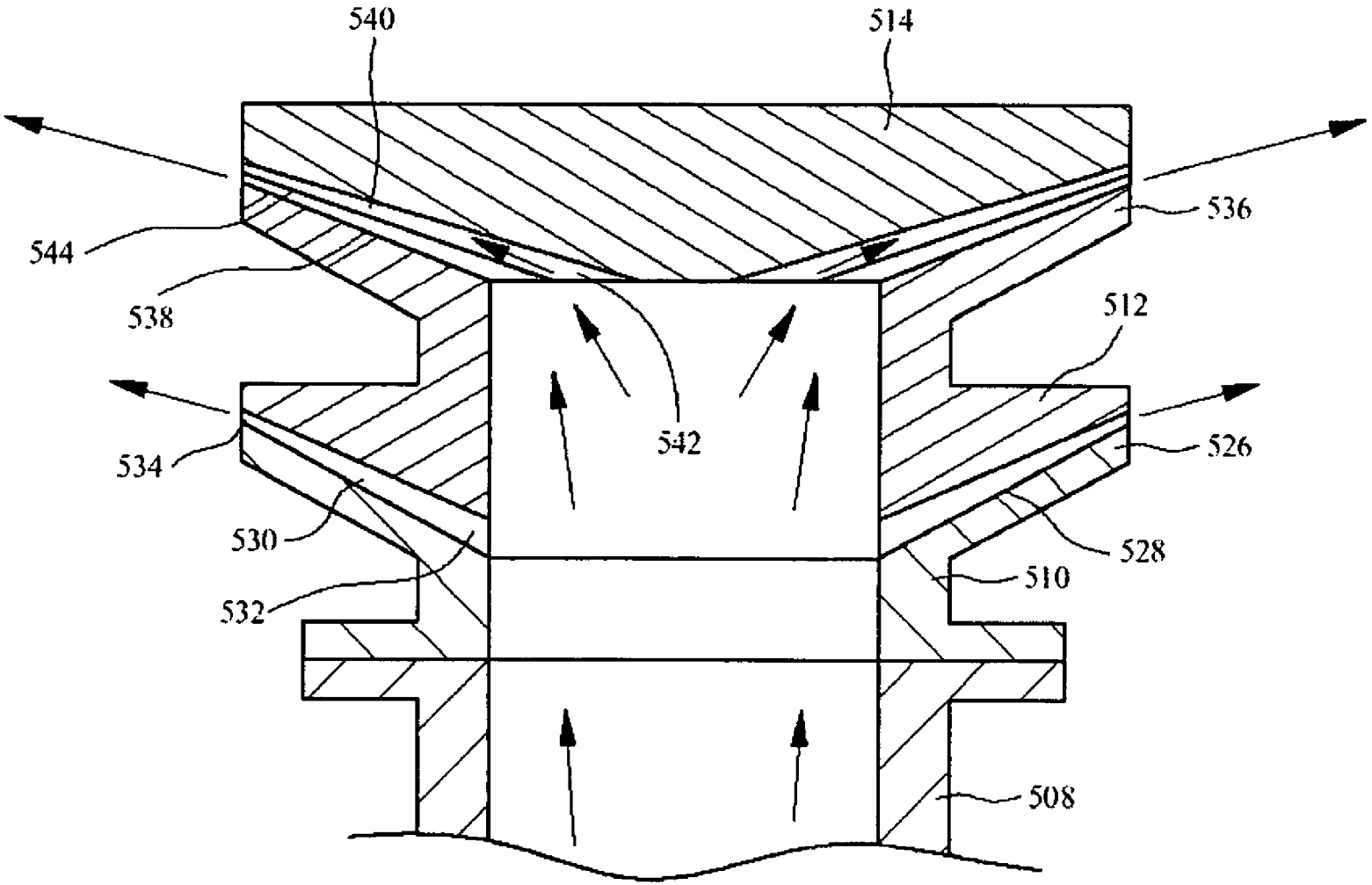
FIG. 9 is a schematic diagram showing the operation of a wide-angle ejecting aeration apparatus in accordance with another preferred embodiment of the present invention.
Figure 11:
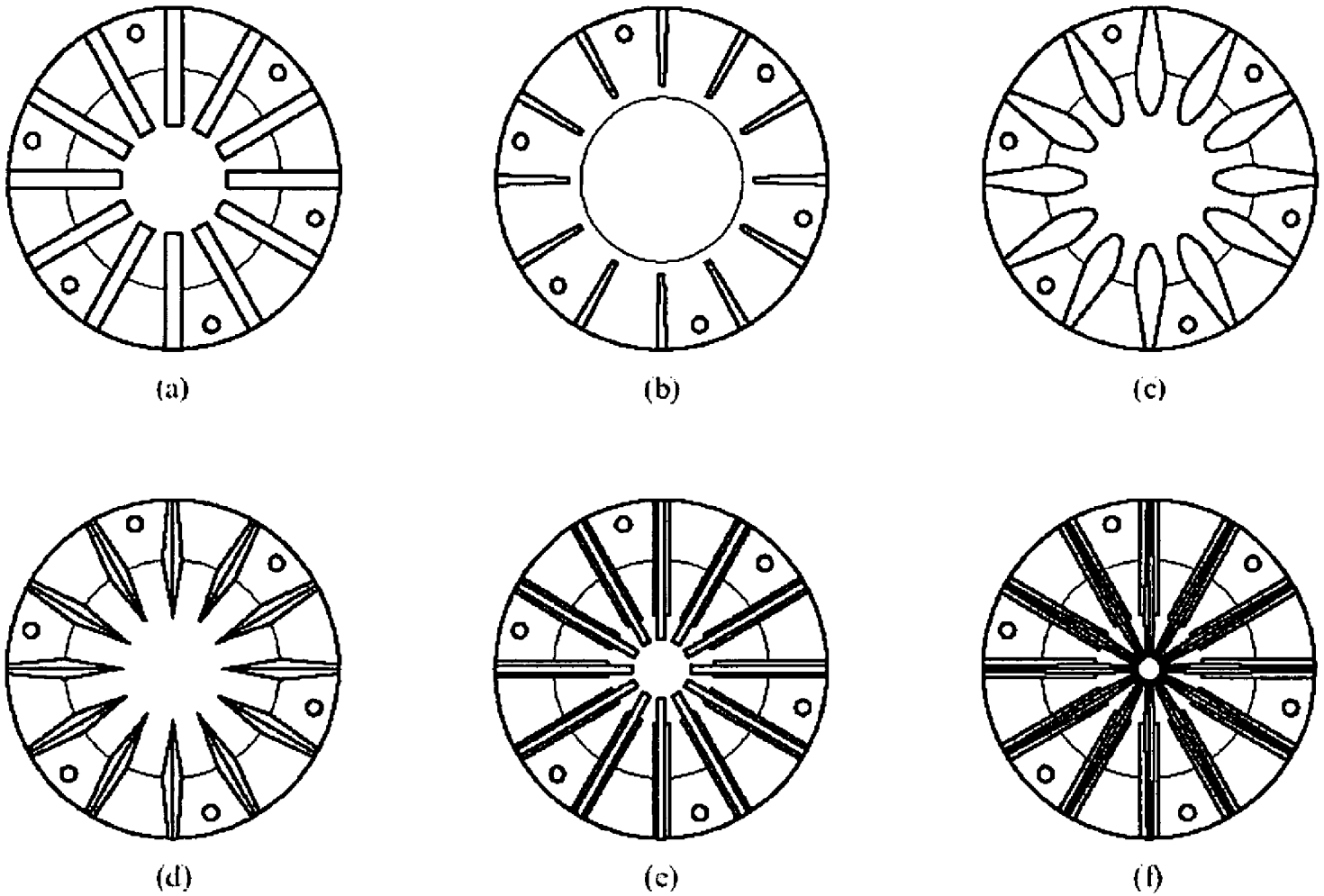
FIGS. 11(*a*) to 11(*f*) are enlarged schematic diagrams of various outlet designs of a spraying main base of a wide-angle ejecting aeration apparatus in accordance with another preferred embodiment of the present invention.

The spraying main base 512 is joined to the connection base 510 (such as shown in FIGS. 6 and 11). The bottom surface of the spraying main base 512 is a cone, which is an inclined plane 528 inclining from the bottom upwardly and outwardly, and the inclined plane 528 is connected to the flange 526 of the connection base 510 correspondingly. Several flow channels 530 are set in the bottom surface of the spraying main base 512 from the bottom and along the inclined plane 528, in which each flow channel 530 is a decreasing channel from an inlet 532 to an outlet 534. The top surface of the spraying main base 512 includes a flange 536. The top spraying main base 514 is located on the top of the wide-angle ejecting aeration apparatus 500, and the top spraying main base 514 is a lid. Referring to FIG. 7, the bottom surface of the top spraying main base 514 is a cone, which is an inclined plane 538 inclining from the bottom upwardly and outwardly, and the inclined plane 538 is connected to the flange 536 of the spraying main base 512 correspondingly. Several flow channels 540 are set in the bottom surface of the top spraying main base 514 from the bottom and along the inclined plane 538, in which each flow channel 540 is also a decreasing channel from an inlet 542 to an outlet 544.

The flow channels 540 in the inclined plane 538 are decreasing channels; the water flows into the flow channel 540 from the inlet 542 with a larger section, then the water is pressurized resulting from the decreasing of the flow channel, and the water is sprayed out. Because the water is pressurized in the flow channel 540, the sprayed water has a lateral velocity to increase the spraying diffusion angle. Besides, with the upward inclined design of the flow channel 540, the spraying diffusion angle is further increased. As a result, the sprayed water ejected from the outlet 544 becomes a plurality of little water droplets, so as to increase the contact time and the contact surface of the sprayed water with the air, effectively increasing the aeration effect and the amount of dissolved oxygen.

Figure 10:
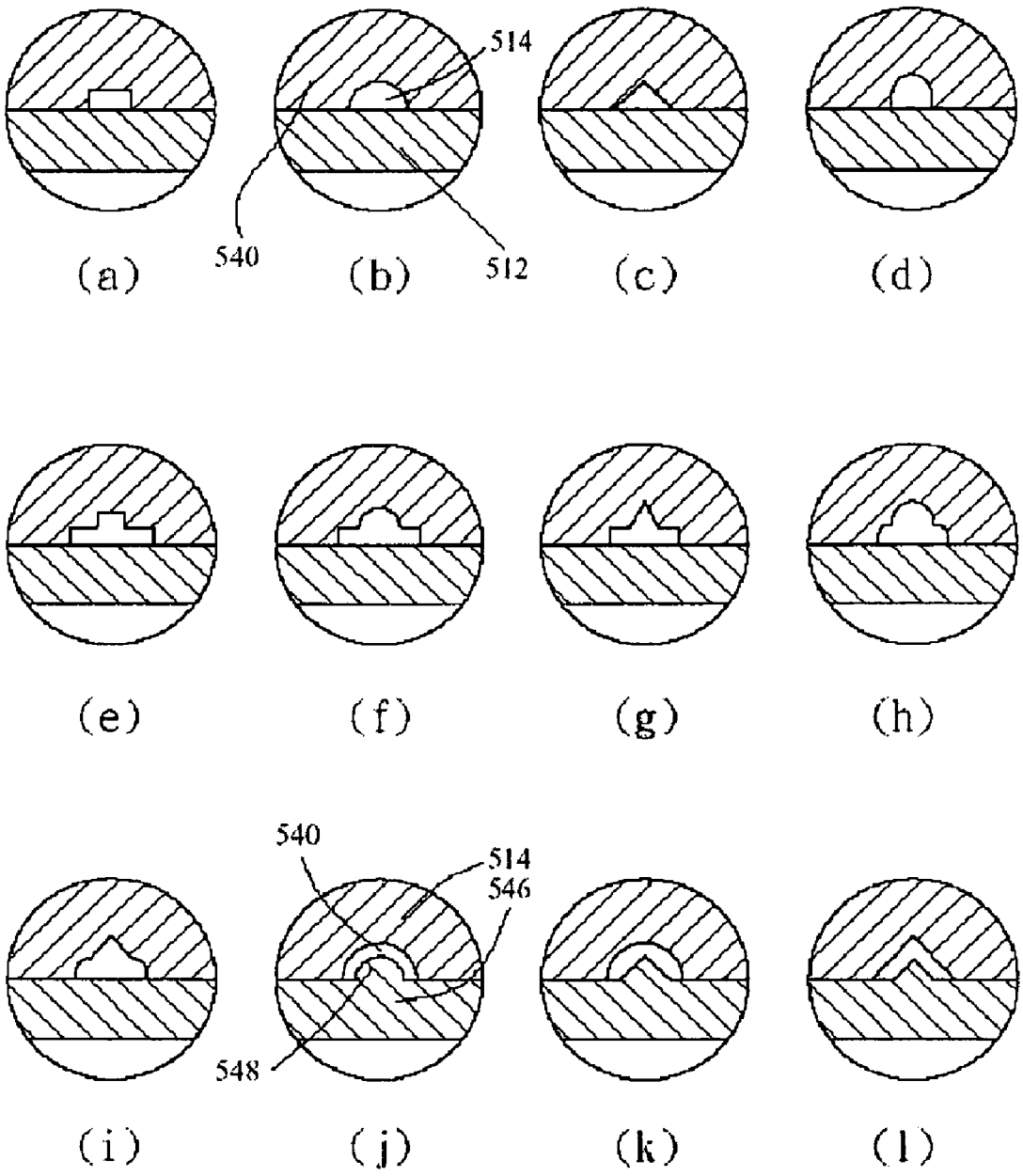
FIGS. 10(*a*) to 10(*l*) are cross-sectional views of various runner designs of a spraying main base of a wide-angle ejecting aeration apparatus in accordance with another preferred embodiment of the present invention.

FIGS. 10(*a*) to 10(*l*) are enlarged cross-sectional views of the connection portion of the spraying main base 512 and the spraying main base 514. The shape of the sections of the outlet 534 and the outlet 544 can be basic shapes, such as a square, semicircle, V-shape or U-shape, in which the relative vertical views are shown in FIGS. 11(*a*) to 11(*c*). When the outlet is of a dual-fillister design, the shape of the section of outlet can be the combination of the basic shapes in FIGS. 10(*a*) to 10(*d*), such as shown in FIGS. 10(*e*) to 10(*i*), and the relative vertical views are shown in FIGS. 11(*d*) to 11(*f*). Certainly, as long as the flow channel design can meet the requirement that the channel size is decreased from the inlet to the outlet, various modifications of shape of the outlet are within the equivalent scope of the present invention.

Each of the inclined planes 528 and the inclined plane 538 is further set with a partition 546, in which the partition 546 can be equipped with a protruding portion or a fillister of various shapes corresponding to the flow channel of the spraying main base, so as to let the protruding portion or the fillister exactly locate in the flow channel, such as shown in FIGS. 10(*j*) to 10(*l*). When the partition 546 includes a protruding portion 548, and the protruding portion 548 is located in the flow channel 540 of the top spraying main base 514, the water is diverted for the benefit of dredging the impurities in the flow channel 540.

According to the aforementioned description, one advantage of the present invention is that the present aeration apparatus of pool water is very durable, and unlike the conventional method, changing the apparatus of the present invention frequently is unnecessary. Therefore, the cost of buying the apparatus and the cost of maintaining the apparatus are obviously lower than the conventional method.

Another advantage of the present invention is that with the application of the present aeration apparatus, the aeration efficiency of the present aeration apparatus is dozens of times that of the conventional waterwheel, so the present aeration apparatus has the advantages of being economical and having high aeration efficiency.

A further advantage of the present invention is that with the application of the present aeration apparatus, the electric power is economized, the amount of the drawn groundwater is decreased to retard the land subsidence, and the aquatic density is enhanced to increase the fish population.

As is understood by a person skilled in the art, the foregoing preferred embodiments of the present invention are illustrated of the present invention rather than limiting of the present invention. It is intended to cover various modifications and similar arrangements included within the spirit and scope of the appended claims, the scope of which should be accorded the broadest interpretation so as to encompass all such modifications and similar structure.

What is claimed is:

1. An aeration apparatus of pool water, comprising:

a pumping device;

at least one pontoon device located at the outer side of the pumping device and connected to the pumping device;

a height adjuster connected to the top of the pumping device; and a top spraying main base connected to the top of the height adjuster, and the top spraying main base is a lid, wherein a bottom surface of the top spraying main base is an inclined plane, a plurality of flow channels are set in the bottom surface and extend toward the edge of the bottom surface of the top spraying main base, and each flow channel is a decreasing channel in which the channel size is decreased from an inlet to an outlet.

2. The aeration apparatus of pool water according to claim 1, further including a partition connected to the inclined plane of the top spraying main base.

3. The aeration apparatus of pool water according to claim 2, wherein a protruding portion or a fillister is equipped in each flow channel of the top spraying main base.

4. The aeration apparatus of pool water according to claim 1, wherein the section of the outlet of each flow channel is of a dual-fillister design.

5. The aeration apparatus of pool water according to claim 1, further comprising a connection base between the height adjuster and the top spraying main base, wherein the height adjuster is connected to and located beneath the connection base, and the top spraying main base is connected to and located on the connection base.

6. The aeration apparatus of pool water according to claim 1, further including at least one spraying main base between the connection base and the top of the connection base, wherein a bottom surface of the spraying main base is an inclined plane, a plurality of flow channels are set in the bottom surface and extend toward the edge of the bottom surface of the spraying main base, and each flow channel of the spraying main base is a decreasing channel in which the channel size is decreased from an inlet to an outlet.

* * * * *